United States Patent [19]

Lisack

[11] Patent Number: 4,802,499

[45] Date of Patent: Feb. 7, 1989

[54] UMBRELLA WITH PISTOL-SHAPED HANDLE AND TRIGGER-ACTIVATED OPENING DEVICE

[76] Inventor: Dennis Lisack, 3710 Trailridge, Louisville, Ky. 40222

[21] Appl. No.: 78,297

[22] Filed: Jul. 27, 1987

[51] Int. Cl.[4] ..... A45B 25/14

[52] U.S. Cl. ..... 135/24; 135/22

[58] Field of Search ..... 135/22, 24, 16, 17, 135/66; D3/12, 13, 14, 16

[56] References Cited

U.S. PATENT DOCUMENTS

| | | | |
|---|---|---|---|
| 363,650 | 5/1887 | Keleber | 135/22 |
| 835,306 | 11/1906 | Mangelsdorf | 135/20 A |
| 2,593,026 | 4/1952 | Hawkins | 135/66 |
| 3,038,483 | 6/1962 | Altsheller | 135/16 |
| 3,906,970 | 9/1975 | Saito | 135/22 |
| 4,149,553 | 4/1979 | Lee | 135/24 |
| 4,418,707 | 12/1983 | Wu | 135/24 |
| 4,421,133 | 12/1983 | Huang | 135/22 |

FOREIGN PATENT DOCUMENTS

| | | | |
|---|---|---|---|
| 143699 | 8/1941 | Fed. Rep. of Germany | 135/22 |

*Primary Examiner*—Henry E. Raduazo
*Attorney, Agent, or Firm*—Scott R. Cox

[57] ABSTRACT

An umbrella with a pistol-shaped handle comprised of a self opening umbrella frame attached to a tubular umbrella shaft connected to a handle portion which is in the shape of a pistol wherein the handle contains a trigger mechanism for opening the umbrella. The umbrella with pistol-shaped handle is useful as a novelty item and can operate in a fashion similar to conventional self-opening umbrellas.

4 Claims, 3 Drawing Sheets

UMBRELLA WITH PISTOL-SHAPED HANDLE AND TRIGGER-ACTIVATED OPENING DEVICE

BACKGROUND OF THE INVENTION

1. Field of Invention

This invention relates to umbrellas. In particular, this invention relates to a conventional self-opening umbrella utilizing a pistol-shaped handle with a trigger-activated opening device as a mechanism for opening the umbrella.

2. Prior art

Umbrellas of varied shape and size with numerous utilities have been developed over many years. Recently, automatic, compressible, self-opening umbrellas, have been developed which are quite popular, because of their ease of operation and their convenient size.

On occasion, there have been attempts to combine with umbrellas various other types of products, either for novelty purposes or with a particular utility in mind. For example, U.S. Pat. No. 4,617,951 discloses a stilleto-type weapon concealed and locked within the handle of an otherwise conventional umbrella. In addition, novelty-type umbrella combinations have been disclosed for example, in U.S. Pat. Nos. 3,038,483 and 4,628,791.

The '483 patent discloses the combination of a child's umbrella and a water pistol. The handle of the umbrella of the '483 patent acts as the storage container and trigger mechanism for the water piston while the shaft of the umbrella encloses a passage through which the water is expelled from the water pistol. The remaining portion of the umbrella acts as a conventional, manually-opened, child's umbrella.

The '791 patent discloses the combination of an umbrella and a music box with a special clip for securing the music box to the umbrella shaft at a location where the canopy-spreading mechanism of the umbrella automatically activates the music box when the umbrella is opened.

While these umbrella combinations are interesting, none have disclosed the combination of a conventional, self-opening umbrella and a pistol-shaped handle, wherein the opening mechanism for the umbrella is the trigger mechanism of the pistol-shaped handle.

Therefore, it is an object of this invention to provide an umbrella with a pistol-shaped handle.

It is another object of this invention to provide a conventional, self-opening umbrella with a pistol-shaped handle, said handle containing a trigger mechanism which opens the umbrella.

It is a further object of the invention to provide novel pistol-shaped handles for attachment to conventional self-opening umbrellas, wherein the trigger mechanism activates the opening mechanism of the umbrella frame.

Other objects and features of the present invention will become apparent from a consideration of the following description, drawings and appended claims. The description with accompanying drawings provides a selected example of construction to illustrate the invention.

SUMMARY OF THE INVENTION

In accordance with the present invention, there is provided an umbrella with a pistol-shaped handle comprising:

a. a self-opening umbrella frame attached to a tubular shaft;

b. a pawl secured to the tubular shaft adapted to open the umbrella when depressed;

c. a pistol-shaped handle, secured to the tubular shaft; and d. a trigger-activated opening means contained in the pistol-shaped handle, adapted to depress the pawl to open the umbrella.

This umbrella with pistol-shaped handle containing a trigger-activated opening means can find great use as a novelty item, particularly for those individuals who might fantasize that the umbrella with the piston-shaped handle is a weapon. In addition, the device functions as a conventional, self-opening umbrella for use in stormy weather.

BRIEF DESCRIPTION OF THE DRAWINGS

The invention will now be described with references to the accompanying drawings in which.

DETAILED DESCRIPTION OF PREFERRED EMBODIMENT

Figure 1:
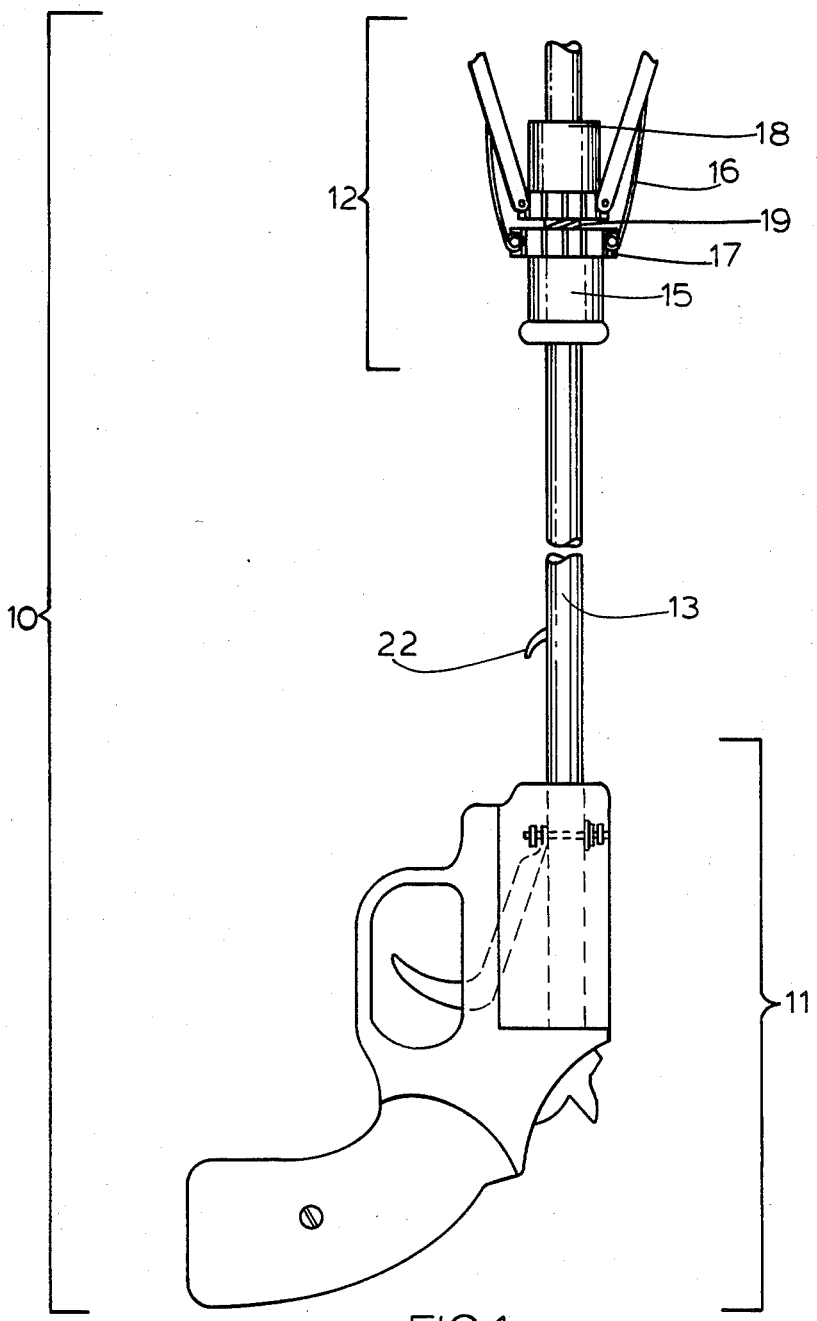
FIG. 1 is a side view of the umbrella with piston shaped handle with the umbrella in its open position.

Although the invention is adaptable to a wide variety of uses, it is shown in the drawings for the purpose of illustration as embodied in a self-opening umbrella (10) with a pistol-shaped handle (11) comprising a self-opening umbrella frame, (12) a tubular umbrella shaft, (13) a pistol-shaped handle, (11) and a trigger-activated opening means (14) for opening the umbrella.

The umbrella frame (12) can be any conventional self-opening umbrella frame which is secured to a conventional tubular umbrella shaft (13). The umbrella frame (12) contains a plurality of dome ribs which are pivoted to a crown at the end of the tubular shaft opposite the handle. A first runner (15) is provided on the shaft and is adapted to slide thereon. A plurality of stretcher members (16) are hinged at one end to a flange (17) on the first runner and at the other end, they are hinged to the dome ribs. A second runner, (18) which also slides on the shaft is provided with a plurality of strut members hinged to the flange of the runner into the stretcher members. A compression spring (19) is provided between the runners. The compression spring is fully compressed when the umbrella is in a closed position and tends to separate the runners when the runners slide up the umbrella shaft thereby forcing the umbrella to an open position. See FIG. 1.

Figure 2:
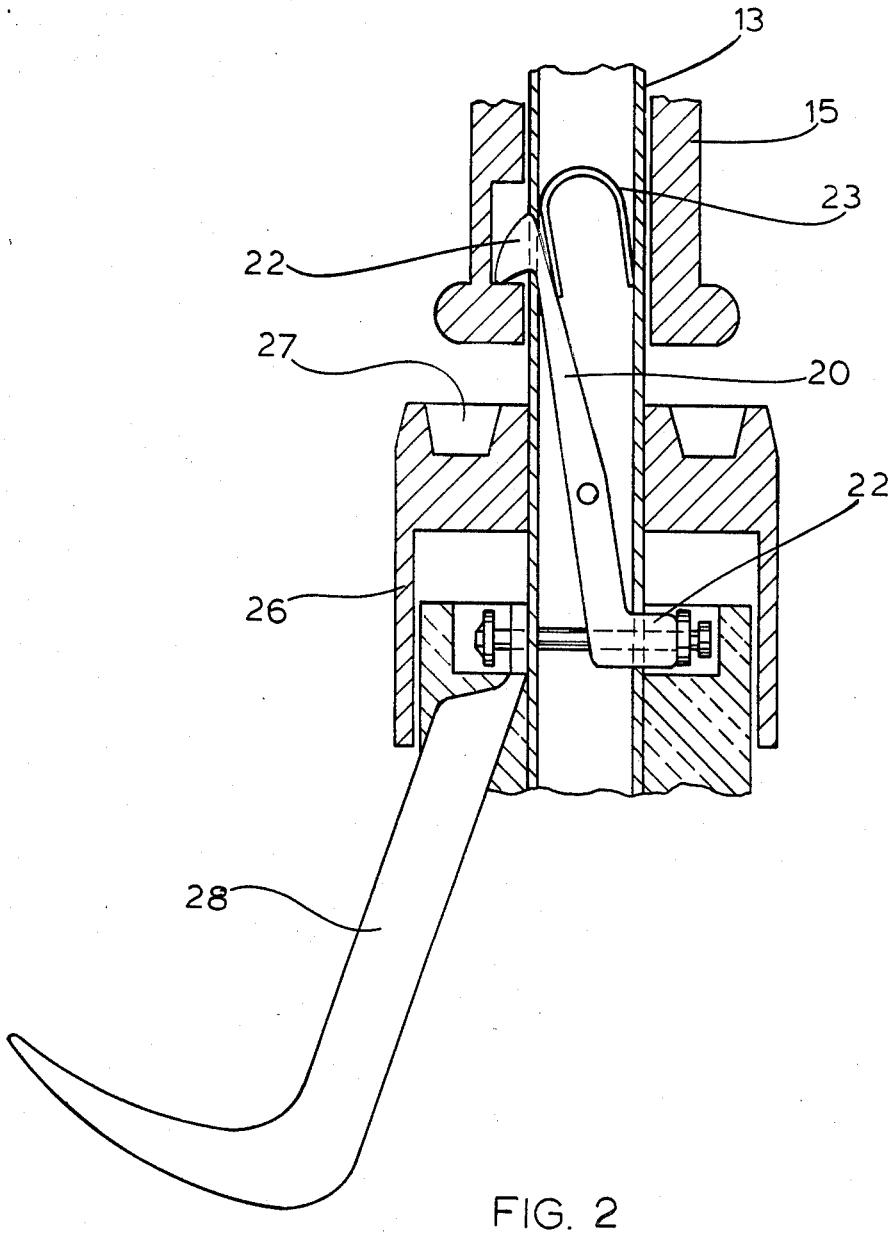
FIG. 2 is a side cut away view of the umbrella with pistol-shaped handle with the umbrella in its closed position.
Figure 3:
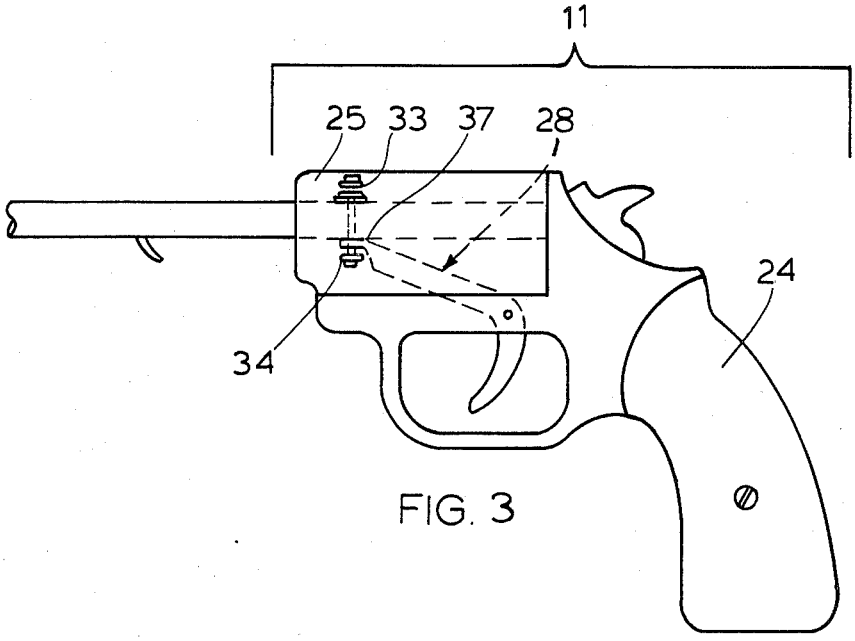
FIG. 3 is a side cut away view of the pistol-shaped handle showing the operation of the trigger.

Located principally within the tubular shaft is a blade-type pawl (20) with an abutment head (21) and at least one locking head (22), which protrudes through the surface of the tubular shaft. See FIG. 2. The abutment head projects through the tubular shaft within the handle and is depressed by the trigger-activated opening means (14). The locking head also protrudes through an opening in the tubular shaft and restrain the upward movement of the runners on the tubular shaft. Although only a single locking head (22) is necessary for release of the runners, in a preferred embodiment, a second locking head is provided to allow the runners to be held in a partially open position. The locking head or heads may be located on the same side of the tubular shaft as is the abutment head (21) or on the opposite side. See FIG. 3. When the locking head (22) protrudes through the opposite side of the tubular shaft to the abutment head (21), the pawl (20) pivots on a pivot point approximately in the middle of the tubular shaft, such that when the abutment head (21) of the pawl is depressed on one side of the shaft, the locking head (22) or head located on the opposite side of the shaft disengages the runner or runners (15, 18). Located adjacent to the pawl and acting against the locking head of the pawl is a spring (23) which forces the abutment head and the locking head outward through openings in the tubular shaft unless depressed by the trigger-activated opening means (14).

The handle (11) of the umbrella, which is attached to the end of the tubular shaft, consists of a pistol-shaped grip, (24) an annular member, (25) and a trigger-activated opening means (14). Although the pistol-shaped grip (24) can be of any form, in a preferred embodiment, the handle is in the shape of an western-style pistol. See FIG. 3.

The annular member is connected to the handle and includes an annular skirt (26) extending therefrom and an annular reset (27) in the top portion of the annular member (25) thereof for receiving the ends of the dome ribs.

Figure 4:
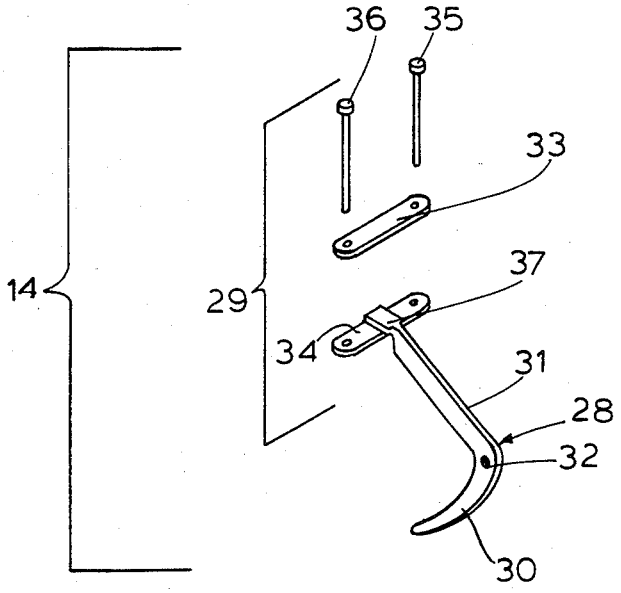
FIG. 4 is an exploded view of the trigger-activated opening means which is secured within the pistol shaped handle.

The trigger-activated opening means (14) operates as a means to open the umbrella when it is in its closed position. The trigger-activated opening means is comprised of a pivot lever (28) and a trigger linkage (29). The pivot lever (28) interacts with the trigger linkage (29) to depress the abutment head (21) and open the umbrella when it is in a closed position. See FIG. 4.

The pivot lever is generally L-shaped wherein the base (30) of the pivot lever acts as the trigger of the pistol-shaped grip (24). The second side (31) of the pivot lever interacts with the trigger linkage (29). At the point where the base (30) of the pivot lever and the second side (31) of the pivot lever meet is an opening (32) for a pivot pin. The pivot lever is secured within the pistol-shaped grip by securing the pivot pin through the opening in the lever in such a fashion as to allow the lever to pivot about the pivot pin.

The trigger linkags is comprised of an upper plate, (33) a lower plate (34) and two trigger linkage pins (35, 36) which connect the two plates. Each of the plates is generally rectangular in shape, approximately ¼ to 1 inch in length and approximately 1/16 to ½ of an inch in width. The plates are generally flat with a thickness of about 1/100 to ¼ of an inch. The upper plate (33) is located directly above the abutment head (21) of the pawl. The lower plate (34) is located on the opposite side of the umbrella shaft from the upper plate. The two trigger linkage pins (35, 36) run through and are secured to the upper plate on each side of the umbrella shaft and are also secured to the lower plate. The trigger linkage pins (35, 36) can be of any conventional type which will secure the plates and allow them to act in a cooperative fashion, so that when one plate moves, the other plate moves in the same or similar direction. The end (37) of the second side (31) of the pivot lever extends between the lower plate (34) and the shaft (13) of the umbrella. When the base (30) of the pivot lever is contracted, the end (37) of the second side of the pivot lever pulls down on the lower plate (34) of the trigger linkage which acts in a cooperative fashion to pull down the upper plate of the trigger linkage which then depresses the abutment head (21) of the pawl (20).

In operation, to open the umbrella when it is in its closed position, the base (30) or trigger portion of the pivot lever (28) is pulled. The second side (31) of the pivot lever pulls down on the lower plate (34) of the trigger linkage (29) which cooperatively pulls the upper plate (33) of the trigger linkage downward to depress the abutment head (21) of the pawl (20). By depressing the abutment head, (22) the locking head of the pawl is also depressed within the tubular shaft (13) which releases the runners (15, 18). The spring (19) between the runners forces the runners apart causing the umbrella to open in a known manner. To close the umbrella the runners must be manually pulled downward so the runners once again engage the locking head (22).

I claim:

1. An umbrella with a pistol-shaped handle comprising:
   a. a self-opening umbrella frame attached to a tubular shaft;
   b. a pawl containing a first opening means secured to the tubular shaft adapted to open the umbrella when the first opening means is depressed;
   c. a pistol-shaped handle secured to the tubular shaft; and
   d. a trigger-activating second opening means comprised of a pivot lever pivotally secured to the pistol handle and a trigger linkage comprised of an upper plate located above the tubular shaft, a lower plate located below the tubular shaft and a pair of pins which connect the upper plate to the lower plate, wherein said second opening means is contained in the pistol-shaped handle.

2. The umbrella with a pistol-shaped handle of claim 1 wherein the pivot lever is a generally L-shaped lever containing a side base and a second side wherein the base side acts as a trigger for the pistol handle, and the second side is adapted to pull downward the lower plate which, in interaction with the upper plate depresses the opening means of the umbrella.

3. The umbrella with a pistol-shaped handle of claim 1 wherein the first opening means is a blade-type pawl consisting of an abutment head and a plurality of locking heads with the heads of the pawl extending through the surface of the shaft of the umbrella.

4. The umbrella with a pistol-shaped handle of claim 1 wherein the pistol-shaped handle is in the shape of a western-style pistol handle.

* * * * *